US005389149A

United States Patent [19]

Carey et al.

[11] Patent Number: 5,389,149

[45] Date of Patent: Feb. 14, 1995

[54] PAINT SYSTEM

[75] Inventors: Richard J. Carey, Milford; James H. Kelly, Farmington Hills, both of Mich.

[73] Assignee: Monarch Design Company, Inc., Farmington Hills, Mich.

[21] Appl. No.: 164,023

[22] Filed: Dec. 8, 1993

[51] Int. Cl.[6] ..... B05B 7/00

[52] U.S. Cl. ..... 118/302; 118/314; 118/315; 118/316; 118/326; 118/684; 118/696; 118/710; 118/712; 239/304; 239/307

[58] Field of Search ..... 118/684, 696, 710, 712, 118/602, 314, 315, 316, 326, 302; 239/304, 305, 307, 69, 127, 695, 708

[56] References Cited

U.S. PATENT DOCUMENTS

| | | | |
|---|---|---|---|
| 3,870,233 | 3/1975 | Wilhelm et al. | 239/305 |
| 4,337,282 | 6/1982 | Springer | 239/305 |
| 4,357,900 | 11/1982 | Buschor | 118/316 |
| 4,509,684 | 4/1985 | Schowiak | 239/305 |
| 4,593,360 | 6/1986 | Cocks | 118/696 |
| 4,720,801 | 1/1988 | Boll | 118/696 |
| 4,951,600 | 8/1990 | Soshi et al. | 118/326 |
| 5,102,046 | 4/1992 | Diana | 239/305 |
| 5,221,194 | 6/1993 | Konieczynski et al. | 239/708 |
| 5,288,525 | 2/1994 | Diana | 239/305 |

FOREIGN PATENT DOCUMENTS

| | | | |
|---|---|---|---|
| 0192338 | 8/1986 | European Pat. Off. | 118/314 |
| 2190312 | 11/1987 | United Kingdom | 118/316 |

*Primary Examiner*—W. Gary Jones
*Assistant Examiner*—Laura E. Edwards
*Attorney, Agent, or Firm*—Lyman R. Lyon

[57] ABSTRACT

A paint system utilizes a paint pumping station comprising a plurality of small paint pots, one for each color inventoried in the system. A pump is provided for each paint pot and is connected through a like plurality of lines to color changers at each paint station. Each color changer utilizes lighted push buttons that are energized by an encoder that tracks vehicles moving through the spray booth and directs the painter to the proper paint for the vehicle being painted.

4 Claims, 4 Drawing Sheets

PAINT SYSTEM

BACKGROUND OF THE INVENTION

The nature of the truck and van marketplace requires truck and van assembly plants to be capable of painting vehicles in a wide variety of custom colors. Generally, vehicle assembly plants utilize paint circulating systems that require from 20 to 60 gallons of paint to fill the system. Since the amount of paint required to paint a single truck or van is approximately 2 to 3 gallons, there is considerable paint waste associated with painting a single vehicle with a relatively small quantity of custom colored paint. Additional cost is also incurred in cleaning large relatively elaborate paint circulating systems.

SUMMARY OF THE INVENTION

A paint system in accordance with a preferred and constructed embodiment of the present invention maximizes efficiency while minimizing cost by utilizing a plurality of relatively small paint pots that are housed in a paint pumping station. A like plurality of pumps circulate the paint through a like plurality of paint circulating lines to any desired number of paint stations. A combination of manual and automatic controls at each paint station condition the system for painting by selectively energizing the flow of paint at each paint station. Additional controls effect paint recycling, cleaning of the system, and solvent recovery. A solvent turbulator mixes air and solvent in a precise ratio to create a foam that efficiently cleans the system.

Typically, complete color changes can be achieved in minutes as opposed to hours heretofore required for color change. The quantity of paint required to fill the system is reduced to approximately 5 gallons as opposed to 20 gallons and virtually all of the unused paint in the system is recovered thereby minimizing waste.

More specifically, the paint system of the present invention utilizes a paint pumping station comprising a plurality of 5 to 10 gallon stainless steel paint pots, one for each color inventoried in the system. A pump is provided for each paint pot and is connected through a like plurality of lines to color changers at each paint station. The color changers are connected in series relationship so that each color is available at each color station. A discrete paint line for each paint color carries paint from its dedicated paint pot and pump to each color changer, in series, then returns the paint to its stationary paint pot. Each color changer utilizes lighted push buttons that are energized by a control computer. An encoder tracks vehicles moving through the spray booth and provides a location of each unit within the booth to the control computer which directs the painter to the proper paint for the vehicle being painted.

DETAILED DESCRIPTION OF THE PREFERRED EMBODIMENT(S)

Figure 1A:
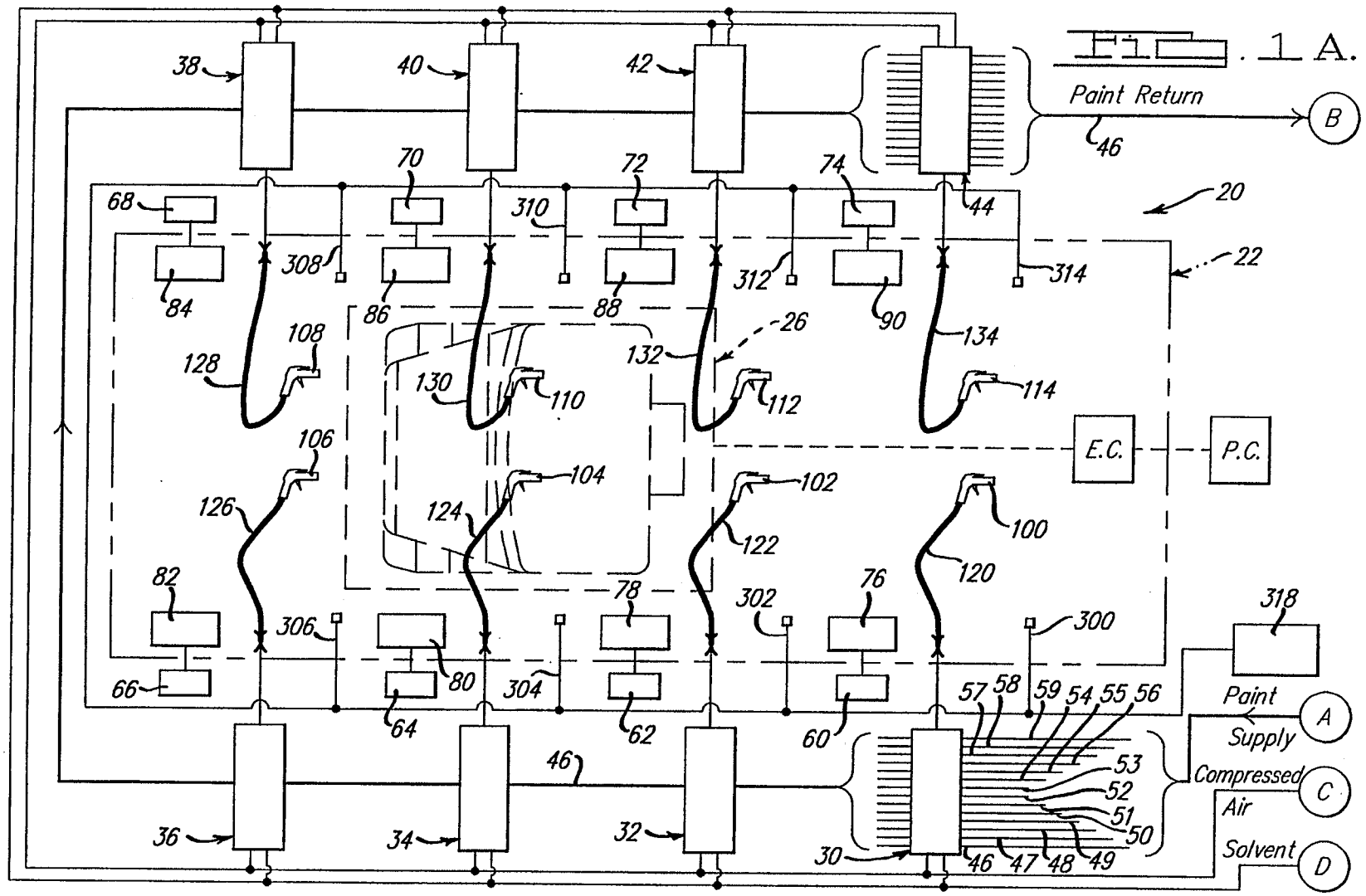
FIGS. 1*a* and 1*b*, when combined, disclose the paint system of the invention.
Figure 1B:
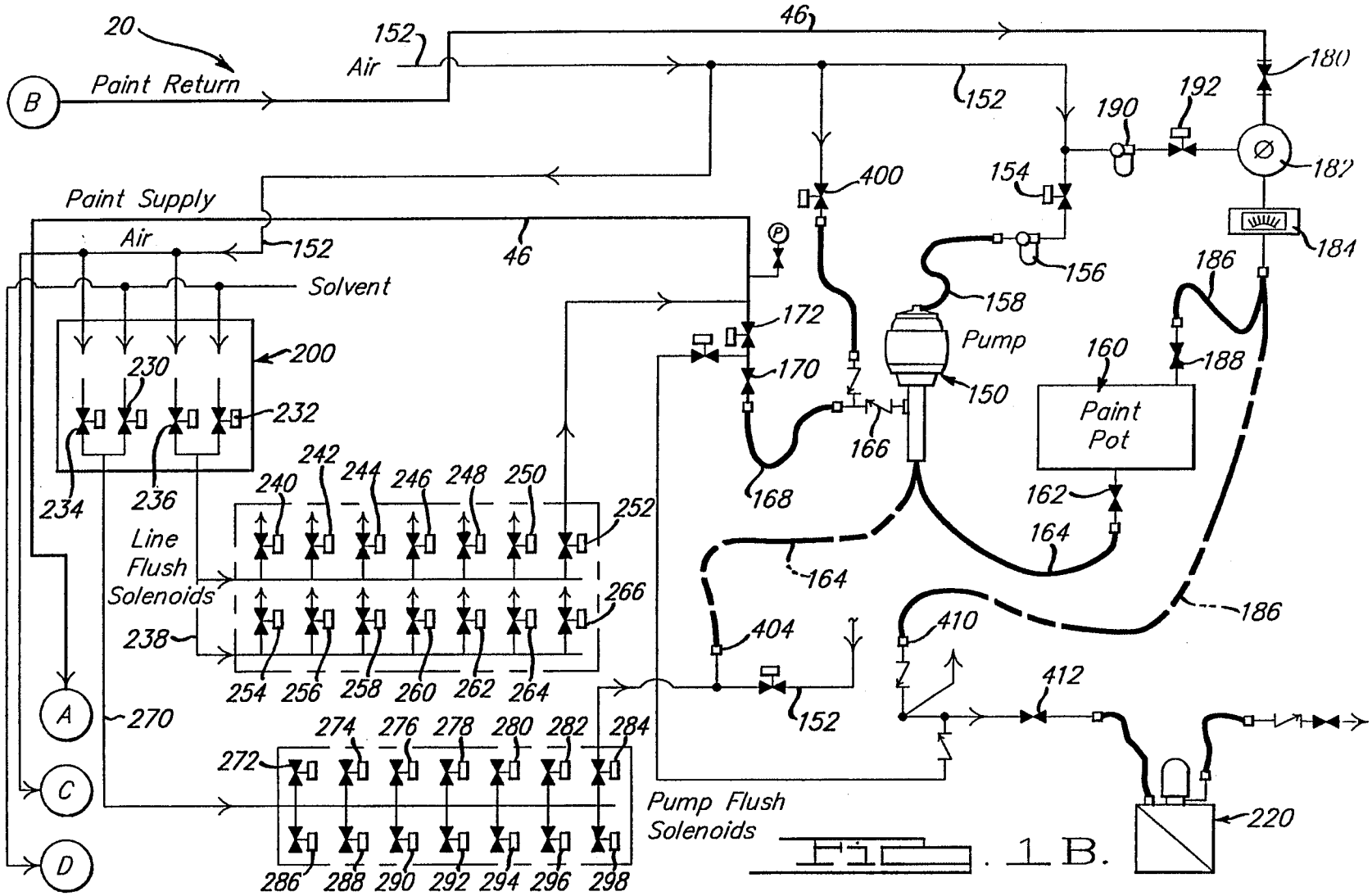

Referring to FIGS. 1*a* and 1*b* of the drawings, a paint system 20, in accordance with an exemplary constructed embodiment of the present invention, comprises a paint booth 22 that accommodates one or more vehicle bodies 24. Conventionally, the vehicle body 24 moves through the paint booth 22 on a skid 26. The essence of the instant invention is a paint system 20 that enables the vehicle 24 to be painted with a custom color in an economical manner from the standpoint of both time and paint utilization.

The paint system 20 comprises a plurality of color changers 30 through 44 that are connected, in series relationship, by, for example, fourteen (14) discrete paint lines 46 through 59. A paint line is provided for each color accommodated by the system. Thus, in the disclosed and constructed embodiment of the invention, fourteen (14) colors can be accommodated by the system 20. However, for purposes of clarity, only one line 46 is shown connecting the color changers 30 through 44 in series.

The color changers 30 through 44 are provided with solenoid valve panels 60 through 74, respectively, located exteriorly of the spray booth 22 which, in turn, are controlled by push buttons on a like plurality of push button panels 76 through 90, respectively, located internally of the spray booth 22.

Each of the color changers 30 through 44 services a spray gun 100 through 114, respectively, through discrete flexible paint supply lines 120 through 134, respectively.

Paint is supplied to the system 20 through, for example, the line 46 from a pump 150. It is to be understood that each of the paint lines 46 through 59 is supplied by a separate pump. Only the pump 150, paint line 46 and their associated supply and control system is discussed herein for purposes of clarity.

The pump 150 is energized by compressed air supplied thereto from a line 152 through a solenoid valve 154, pressure regulator 156, and flexible air line 158. Paint is supplied to the pump 150 from a paint pot 160 of, for example, 10 gallon capacity, through a ball valve 162 and flexible line 164. The pump 150 supplies paint under pressure to the line 46 through a check valve 166, flexible paint line 168, ball valve 170, and solenoid valve 172.

Paint is returned through a return portion of line 46 from the color changers 30 through 44, through a ball valve 180, back pressure regulator 182, flow meter 184, flexible paint return line 186, and ball valve 188 to the paint pot 160. The diaphragm of the back pressure regulator 182 is loaded by air pressure from the air line 152 through a regulator 190 and solenoid valve 192.

The system 20 is flushed by aerated solvent or foam produced in a turbulator 200. Aerated solvent flows from the turbulator 200 under the control of solenoid valves 230 and 232 for the solvent, and solenoid valves 234 and 236 for the air. The solvent flows through a line 238 to a bank of solenoid valves 240 through 266 and through a line 270 to a bank of solenoid valves 272 through 296, the function of which will be described hereinafter.

Operation

The paint system 20 is conditioned for painting of a given color by connecting the paint supply hose 164 between the pump 150 and the paint supply solenoid 162 of a paint pot 160, containing a desired color. The paint return hose 186 is then connected from the flow meter 184 to the paint return ball valve 188 on the paint pot 160. The paint pot valves 162 and 188 are then opened.

The system 20 is electronically conditioned for start by entering a vehicle number, a paint code number, and paint line number into a conventional process control computer (PC). As a vehicle 24 enters the spray booth 22 a conventional encoder (EC) transmits vehicle position to the control computer. The computer will search its memory for the appropriate paint which has previously been loaded into a specific paint pot 160 of the paint system 20. When the paint number is found, the computer (PC) energizes the pump 150 and appropriate push button lights at each of the paint station push button consoles 76 through 90. Paint circulates continuously in line 46 through the color changers 30 through 44. In the example illustrated in the drawings, the push buttons at each console 76 through 90 would be lit that control the paint line 46. When the operator pushes any lighted push button at any console 76 through 90, paint flows from the associated color changer 30 through 44, respectively, to its associated spray gun. It is to be noted that in the example, only the lighted push buttons controlling line 46 can be activated.

After a predetermined spraying interval, the painter can either energize stop buttons on his associated control console 76 through 90 or the tracking logic in the encoder (EC) and computer (PC) shuts off the color valves controlling line 46 in the color changers 30 and 44.

Spray Gun Line Flush

Figure 4:
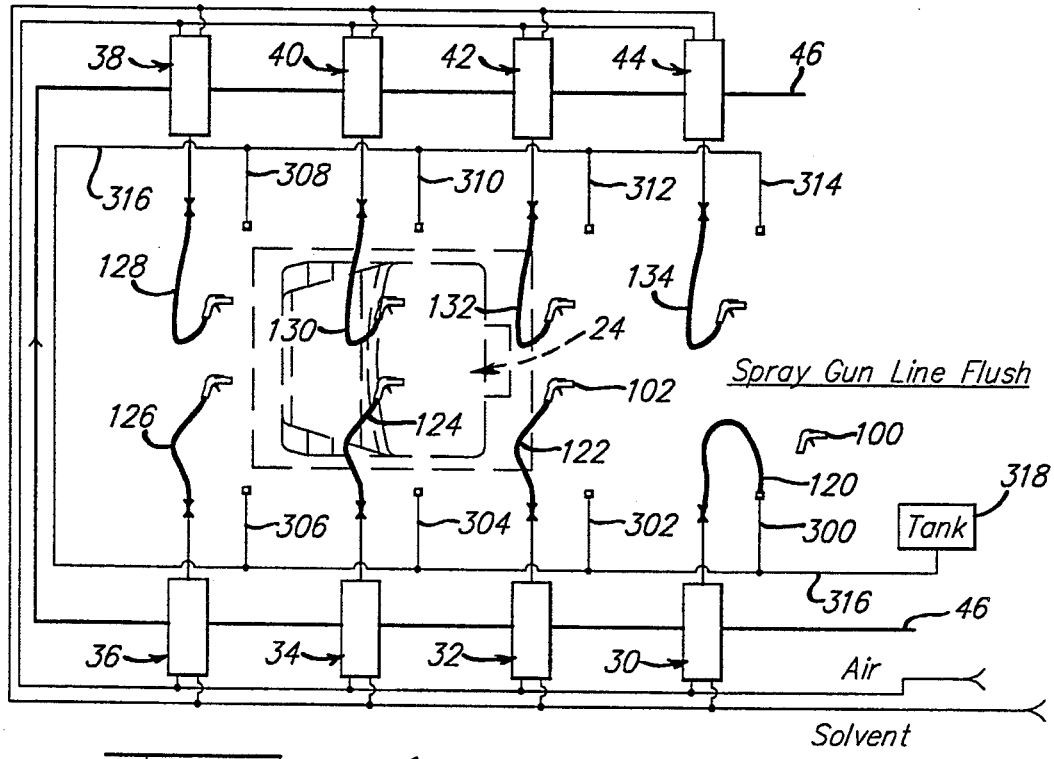
FIG. 4 is a view of the spray gun line flush fluid circuit.

As best seen in FIG. 4, after a vehicle 24 passes a particular color changer 30 through 44, its associated spray gun line 120 through 134, respectively, is flushed. Flushing is initiated by first closing the color valve in a color changer 30 through 44 by pushing an appropriate push button on the corresponding color console 76 through 90. The painter then disengages an associated spray gun 100 through 114 from a gun line 120 through 134 and attaches the line 120 through 134 to an associated solvent flush connector 300 through 314, respectively. All of the connectors 300 through 314 are connected to a common solvent return line 316 thence to a solvent collection tank 318.

As shown in FIG. 4, the spray gun 100 has been detached from the spray gun line 120 and the line 120 has been reattached to the connector 300 of the solvent return line 316. The operator then presses a purge push button on the console 76 which automatically initiates a cleaning cycle of the color changer 30 and spray gun hose 120 by alternately opening the solvent and air solenoids of the color changers. The opening, closing and time duration sequence is controlled by the control computer. Solvent and air flows through the color changer 30 and line 120 for return to the tank 318. The lines 120 through 134 are flushed successively as the vehicle 24 moves through the spray booth 22.

Paint Recovery

Figure 2:
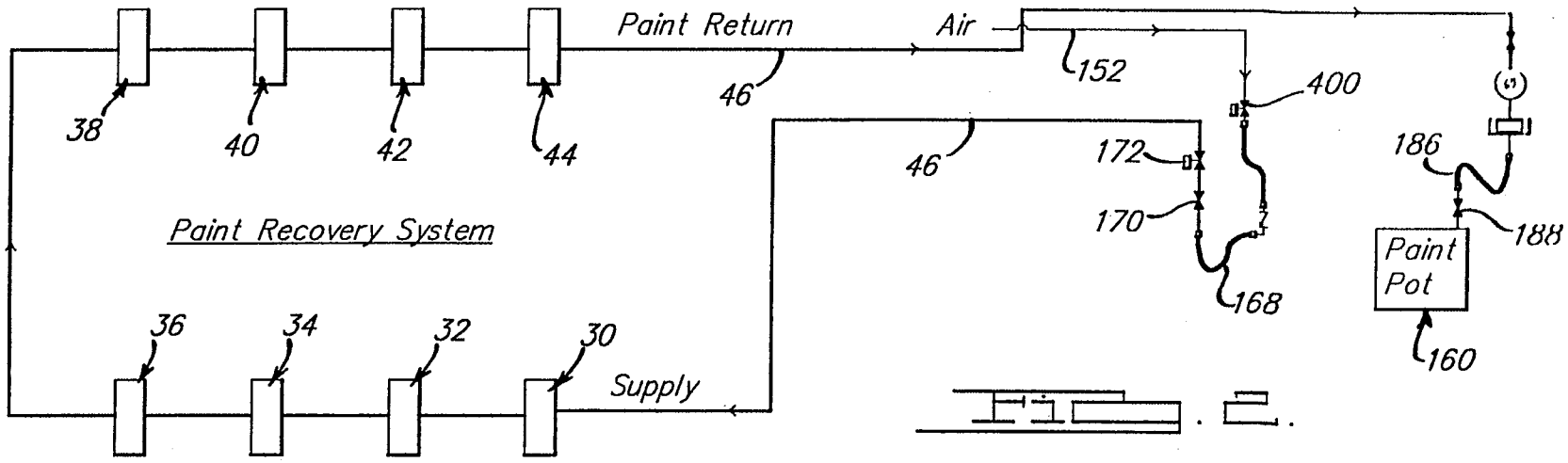
FIG. 2 is a view of the system of FIGS. 1*a* and 1*b* in the paint recovery mode.

As best seen in FIG. 2, after a vehicle 24 has passed through the booth 22 and there is no future requirement for the color, as dictated by the control computer (not shown), the paint line, for example paint line 46, is purged of paint. The control computer terminates the flow of paint by shutting off the pump 150 and then opening a paint blowdown valve 400 in air line 152 and closing valve 192 which fully opens the back pressure valve 182 so as to blow the paint through the line 46 back to the paint pot 160.

Line Flushing

Figure 3:
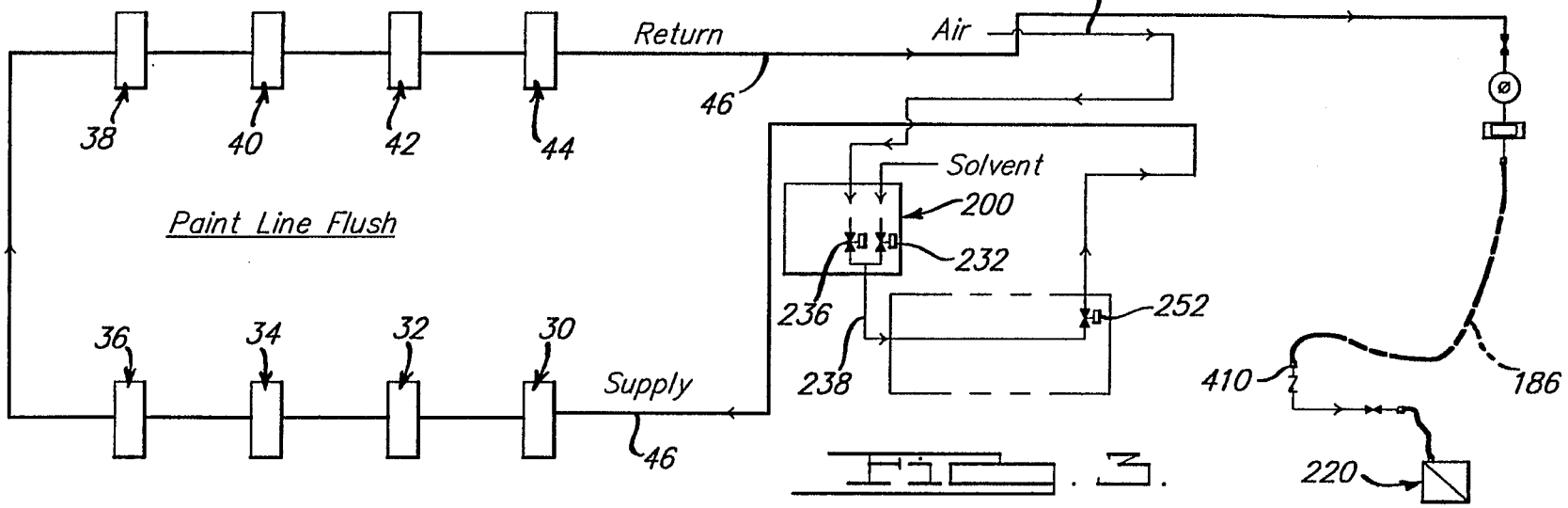
FIG. 3 is a view of the system in the line flush mode.

After the paint line has been cleared of paint, and as seen in FIG. 3, the operator disconnects the paint inlet hose 186 from the paint pot 160 and connects it to a solvent connection 410. He then opens solvent and air line valves 236 and 232 so as to initiate foamed solvent flow through line 238, valve 252, lines 46 and 186 to tank 220. After a predetermined period the solvent valve 232 is closed to initiate flow of compressed air only to effect compressed air blowdown.

Pump Flushing

Figure 5:
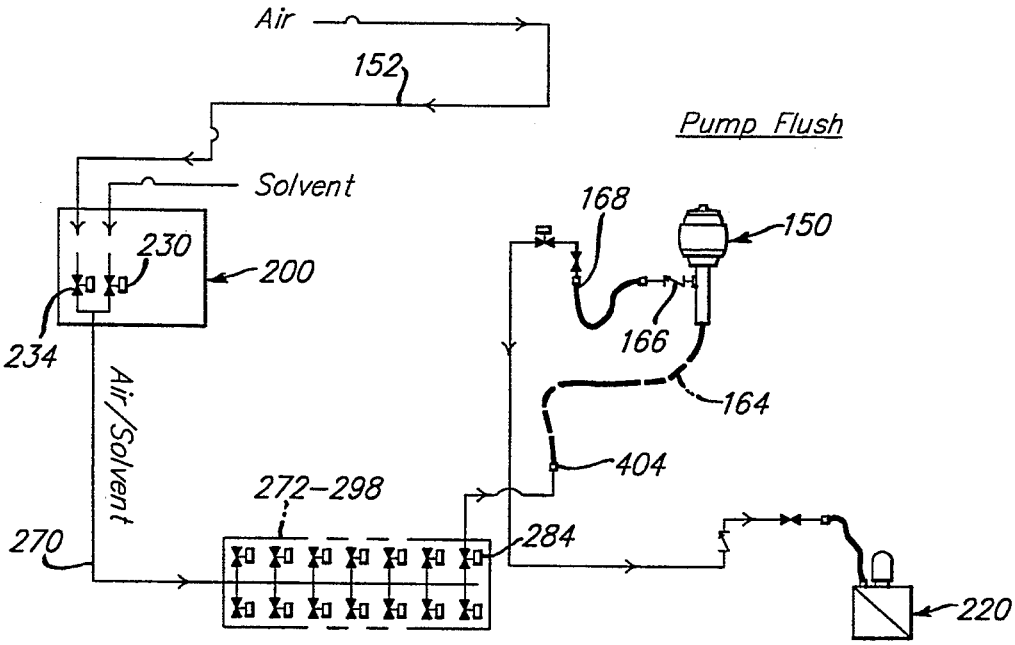
FIG. 5 is a view of the pump flush fluid circuit.

As seen in FIG. 5, flushing of the pump 150 is initiated by disconnecting the pump inlet hose 164 from the paint pot 160 and connecting it to a solvent connection 404. A pump flush control is then energized opening the air and solvent valves 234 and 230, respectively, in the turbulator 200 and starting the pump 150. Solvent is pumped through the line 270, valve 284, line 164, pump 150, and line 168 to the tank 220. The solvent valve 230 is closed after a set period and compressed air only flows through the pump 150 effecting final blowdown.

While the preferred embodiment of the invention has been disclosed, it should be appreciated that the invention is susceptible of modification without departing from the scope of the following claims.

I claim:

1. A paint system comprising:

a plurality of paint pots;

a plurality of paint pumps;

a plurality of color changers;

a spray gun; and a plurality of paint circulating lines extending in series loop relationship between said paint pots, paint pumps, color changers and back to said paint pots, respectively, each of said color changers accepting said spray gun for connection to a discrete paint circulating line, selectively, each of said paint pumps being energizable, selectively, to constantly circulate paint through its associated paint circulating line from its associated paint pot to its associated color changer thence back to its associated paint pot.

2. A paint system in accordance with claim 1 including a spray booth having a plurality of controls internally thereof connected to and controlling said color changers, respectively.

3. A paint system in accordance with claim 1 including a solvent line and an air line connectable to said spray gun, paint circulating lines, pumps, and paint pots, selectively to effect purging thereof.

4. A paint system in accordance with claim 1 including a computer connected to said color changers for control thereof and an encoder connected to said computer for transmitting the identification and position of a work piece to said computer.

* * * * *